United States Patent [19]

Davis

[11] 4,134,480

[45] Jan. 16, 1979

[54] HANDLE ASSEMBLY FOR LUGGAGE CASE

[75] Inventor: Michael Davis, New Castle, Pa.

[73] Assignee: Airway Industries, Inc., Ellwood City, Pa.

[21] Appl. No.: 886,645

[22] Filed: Mar. 15, 1978

[51] Int. Cl.[2] ..... A45C 13/26

[52] U.S. Cl. ..... 190/58 B; 16/115; 16/125; 29/509

[58] Field of Search ..... 190/57, 58 R, 58 A, 190/58 B, 39; 16/115, 125, 126; 29/526 A, 526 R, 509

[56] References Cited

U.S. PATENT DOCUMENTS

| | | | |
|---|---|---|---|
| 1,554,228 | 9/1925 | Olshan | 190/58 R |
| 2,106,911 | 2/1938 | Garfinkel | 190/58 B |
| 2,195,028 | 3/1940 | Finkelstein | 190/58 B |
| 2,242,283 | 5/1941 | Avery | 190/58 B |
| 3,243,020 | 3/1966 | Friedlander | 190/57 |
| 3,566,436 | 3/1971 | Marks | 190/58 B X |

*Primary Examiner*—Donald F. Norton

*Attorney, Agent, or Firm*—Buell, Blenko & Ziesenheim

[57] ABSTRACT

A handle assembly for a luggage case having a hand-grip member made of a single piece of strap folded longitudinally into multiple layers so as to form flat slots at opposite ends, through which coupling loops extend for joining the hand-grip member to anchor clips attached to the frame of the luggage case. The coupling loops may shift inwardly and outwardly in the flat slots to enable the hand-grip member to assume an upper or a lower position. The single piece of strap forming the hand-grip member has a longitudinal coextensive strap or wire of semi-rigid deformable metal embodied in the strap, which permits flexible deformation of the hand-grip member optionally into an arched or curved form in which it remains for use in carrying the luggage case, or into a flat or depressed form for storage or shipment in close side-by-side relation to other luggage cases. A number of combinations with several devices for attaching the hand-grip member to the body or frame of a luggage case are disclosed.

9 Claims, 18 Drawing Figures

HANDLE ASSEMBLY FOR LUGGAGE CASE

This invention relates to a handle assembly for a luggage case, and has particular relation to a hand-grip member forming part of the assembly, which is flexibly deformable into an arched or curved semi-rigid contour for use in carrying a luggage case or which may be optionally depressed or flattened into a flat contour for close side-by-side storage of a plurality of luggage cases.

Handles or hand-grip members attached, as by metal loops, to a luggage case for carrying the luggage case are customarily of a rigid arched or curved contour convenient for the grasp by the hand of the carrier. Sometimes the hand-grip member is padded or of a resilient material or composition to protect the hands of the carrier.

Alternately, the handle or hand-grip member may be a flat strap which is flexibly secured at opposite ends to the body of the luggage case. Such a form of hand-grip member is convenient from the standpoint of packing a luggage case in a carton for shipment or storage but it is not as convenient for accessibility to or accomodation of the hand or fingers of the carrier.

It is an object of my present invention to provide a handle assembly for a luggage case having a hand-grip member which is optionally deformable into an arched or curved contour, for ease of accessibility and grasping by the hand or which may be depressed or flattened into a straight line for ease in packing luggage cases in cartons or in bulk side-by-side relation.

More specifically I provide a handle assembly for a luggage case comprising a hand-grip member in which a metallic reenforcing member, such as a strap or a wire of malleable aluminum for example, is embodied which enables the optional deformation of the hand-grip member into arched or flat contour and which causes the hand-grip member to retain either contour until positively bent into the other contour.

I further provide a handle assembly for a luggage case, having a hand-grip member consisting of a single strap of composite construction, in which the reenforcing metallic strap or wire is longitudinally coextensive, the opposite ends of the strap being folded back longitudinally to form elongated slots at opposite ends of the hand-grip member for receiving therethrough coupling loops by which the hand-grip member is flexibly attached to the frame or body of the luggage case. Optionally, the strap may be folded back on itself so as to provide two or more layers, to provide different depths in the hand-grip portion, to adapt to differend types of luggage cases.

The above described and other details will become apparent in the description of a preferred embodiment hereinafter fully set forth, when read in connection with the accompanying drawings, wherein.

Figures 1, 2, 3, 4:
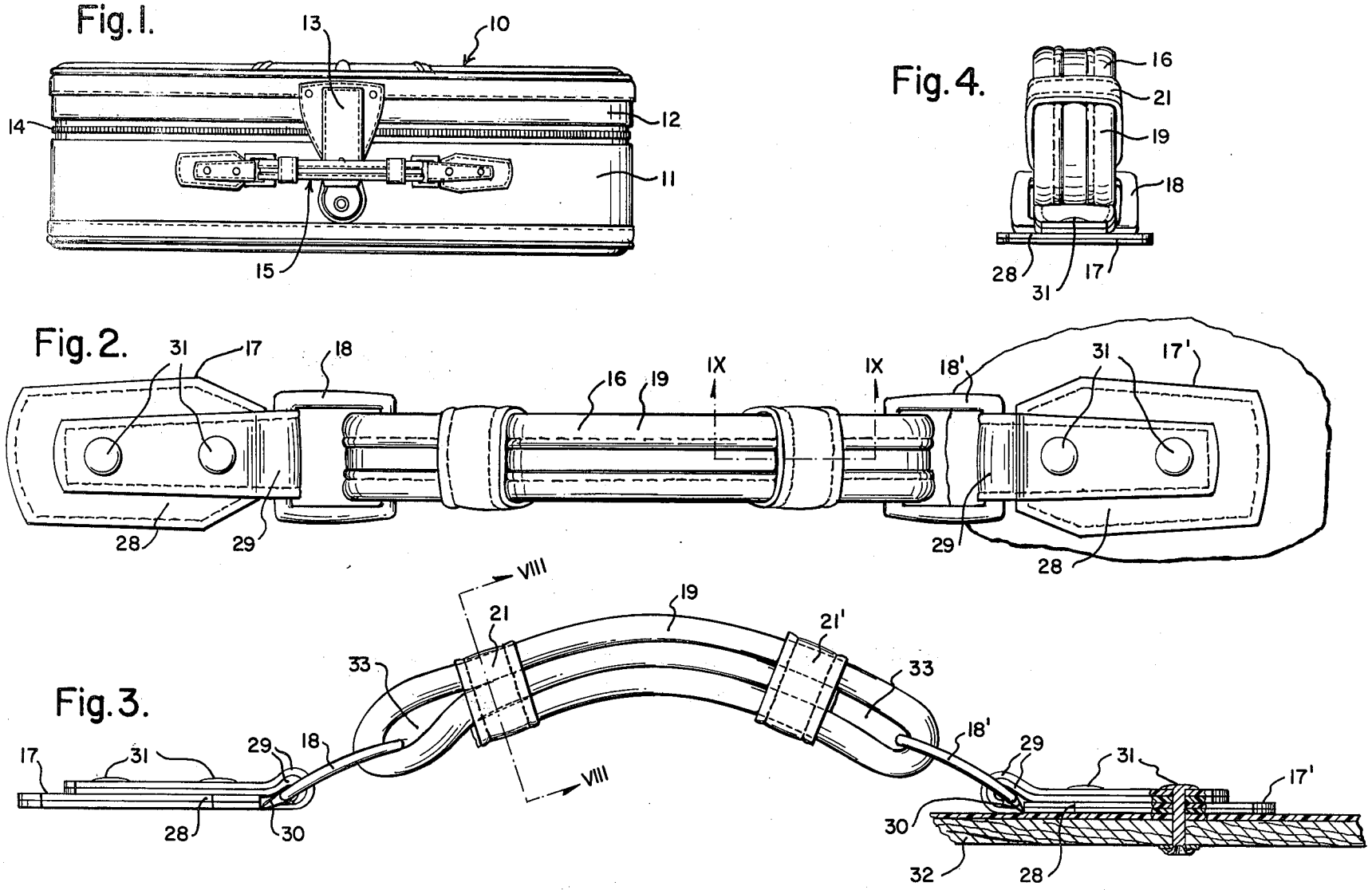
FIG. 1 is a top plan view of a luggage case showing my preferred embodiment of handle assembly and the manner of attachment thereof to the frame or body portion of the luggage case.
FIG. 2 is a view, on enlarged scale, of the handle assembly as shown in FIG. 1 in its arched or curved contour.
FIG. 3 is a side elevational view of the handle assembly of FIG. 2.
FIG. 4 is an end elevational view of the handle assembly of FIG. 3.

Referring to FIG. 1, there is shown a luggage case 10 having a body portion 11 and a hinged cover or lid 12. By way of example, a locking tab 13 is secured as by riveting, to the lid 12 and has a latch at the end thereof which engages in a lock on the top wall of the body portion. The body 11 and lid 12 are also provided along mating edges thereof with a slide fastener 14, the slides of which are not visible in the drawing.

A preferred embodiment of my handle assembly 15 is shown in FIG. 1 as attached to the top wall of the frame of the body portion of the luggage case in symmetrical straddling relation to the locking tab 13.

Referring now to FIGS. 2, 3 and 4, it will be seen that the handle assembly 15 comprises a hand-grip element 16, two identical anchoring tabs 17 and 17' and two identical rectangular metal loops 18 and 18' for connecting opposite ends of the hand-grip portion 16 to the respective anchoring tabs.

The hand-grip portion 16 comprises a single length of strap 19 (FIG. 3) made of suitable flexible sheet or strap material, such as sheet leather or suitable vinyl sheet, the opposite ends of which are folded back from the central portion into a position overlapping each other and back against the central portion. To hold the triple thickness layers or plies of the strap 19 together, a rivet 20 is provided which is inserted through a hole prepunched or pre-drilled in the various layers of the strap. Bands 21 and 21', of leather or vinyl strap materials, formed by stitching opposite ends together (FIG. 8) are slipped in light-fitting relation over the outside of the hand-grip portion into surrounding relation in line with the rivets 20.

Figure 9:
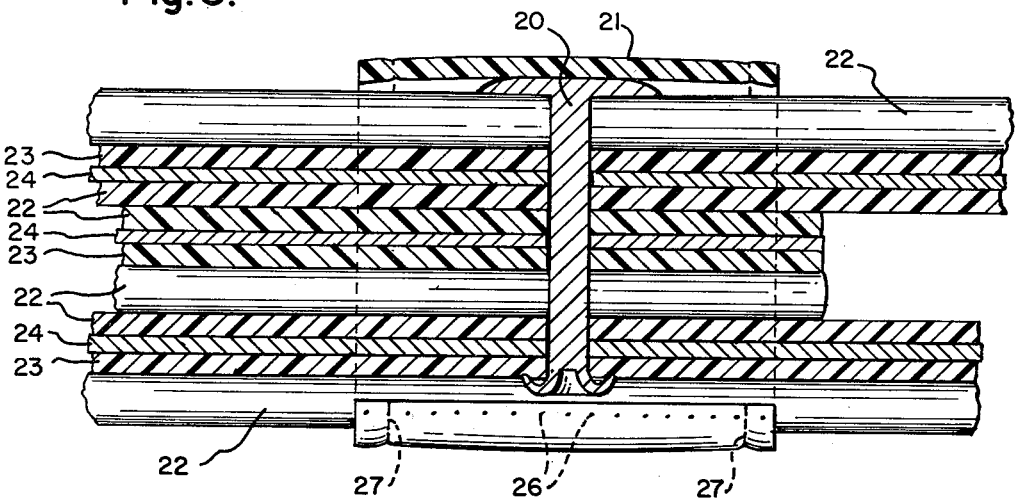
FIG. 9 is a longitudinal sectional view, on enlarged scale, taken on the line IX—IX of FIG. 2, showing additional details of the hand-grip portion of the handle assembly.
Figure 8:
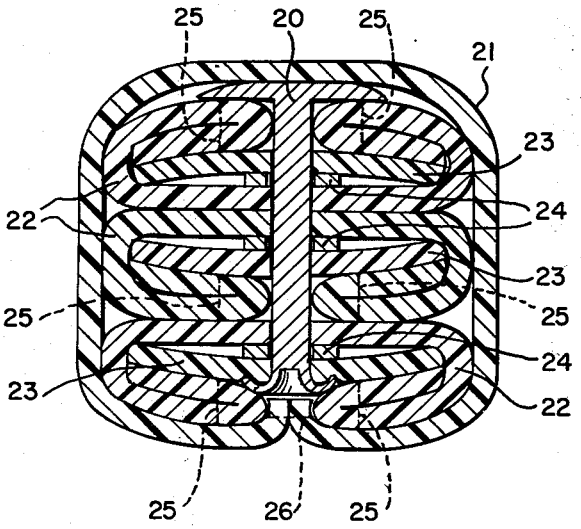
FIG. 8 is a cross-sectional view, on enlarged scale, taken on the line VIII—VIII of FIG. 3, showing further details of the hand-grip portion of the handle assembly.

Referring now to FIGS. 8 and 9, further details of construction of the hand-grip portion 16 will now be described. It will be understood that the strap 19 is cut to suitable length, as from a roll thereof. The strap 19 in its free or roll form is formed by a relatively wide member 22, a narrower member 23 and a relatively narrow reenforcing strip 24 of suitable semi-rigidity metal, such as malleable aluminum. The nature of the metal of which strip 24 is made is such that it may be bent or deformed from one to another contour. Upon removal of the deforming force, the metal strip remains in the contour to which it has been bent.

The strap 19 is formed with the metal strip 24 interposed centrally between the relatively wide member 22 and the narrower member 23, and with the opposite edges of the wide member 22 folded over longitudinally and then bent into overlapping relation to the narrower member 23. The folded-over edges of wide member 22 are held in folded-over position by stitching through the two thicknesses of the folded-over portion at 25.

After the piece of strap 19, cut from the roll, is folded into its triple layer or ply form, as shown in FIG. 3, holes are punched or preferably drilled, through the three layers of the strap, following which rivets 20 are inserted individually into the holes and machine riveted to press the three layers of strap tightly together. As shown, the rivets 20 have a head of relatively larger diameter and rounded contour. While not shown in FIGS. 8 and 9, a washer may be inserted over the end of the rivet before riveting. After the two rivets 20 are installed, the bands or sleeves 21 and 21' are slipped into place.

The bands 21 and 21' are made by stitching the two ends of an appropriate length of strap together, at 26, and also sewing a decorative row of stitches 27 in parallel relation close to the opposite edges of the strap. Following the stitching operations above-described, the band is turned inside out into the form shown.

The anchoring tabs 17 and 17' are similar in construction to the anchoring tabs previously disclosed in my prior copending application Ser. No. 608,079, filed Aug. 27, 1975. Each tab 17 (or 17') comprises a relatively wide pad element 28, which may be of a single thickness of sheet material, such as leather, vinyl or other composition, or of double thickness and a relatively narrow strap element 29 of similar material. The element 29 is of double thickness for a part of its length above the element 28 and around one leg of the metal loop 18 (or 18'), the remaining length of single thickness being longer and extending under the pad element 28. If desired, for purposes of decoration, a line of stitching may be provided closely paralleling the outline of the pad element 28 and of the strap element 29, as shown.

In order to provide strength to the transverse loop formed by strap element 29, a length of reenforcing metal strap 30 is folded over to form a transverse loop and the two end portions are pressed together to form a single finger element that extends in interposed relation between the bottom of pad element 28 and the top of the longer piece of strap 29. A pair of longitudinally aligned holes are provided, as by punching or drilling, through which rivets 31 extend for riveting the anchor tabs 17 (or 17') to the wall or frame 32 of the luggage case, as fragmentarily illustrated in FIG. 3.

The loops 18, 18' may be integrally or separably formed. If integral in form, the respective arms of loops 18 (or 18') must be passed through the end slots 33 at opposite ends of the hand-grip element 16 before installing the rivets 20. Likewise, in such case, the arms of the loops 18 (or 18') must first be passed between the ends of the metal strap 30 into the transverse loop thereof before installing the strap 30 between the longer end of strap 29 and pad element 28 and before attaching the anchor tabs 17, 17' to the body of the luggage case.

If the loops 18, 18' are separable, or split they may, of course, by installed conveniently when it is desired to secure the hand-grip element 19 to the anchor tabs 17, 17'.

It will be seen that in FIGS. 2, 3 and 4, the hand-grip element 19 is illustratively shown in its arched or curved contour, in which the reenforcing or supporting metal strap 24 in the hand-grip element retains it. In this arched contour, the hand-grip element may be conveniently grasped by inserting the fingers of the hand in the arched opening.

Figure 5:
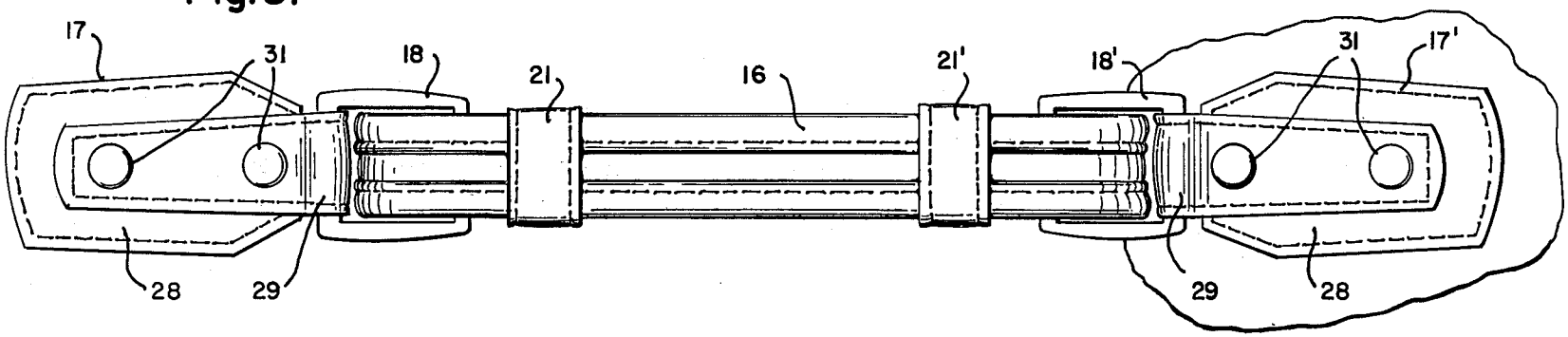
FIGS. 5, 6 and 7 are plan, side elevational and end elevational views, respectively, of the handle assembly as deformed to its flattened contour.
Figure 6:
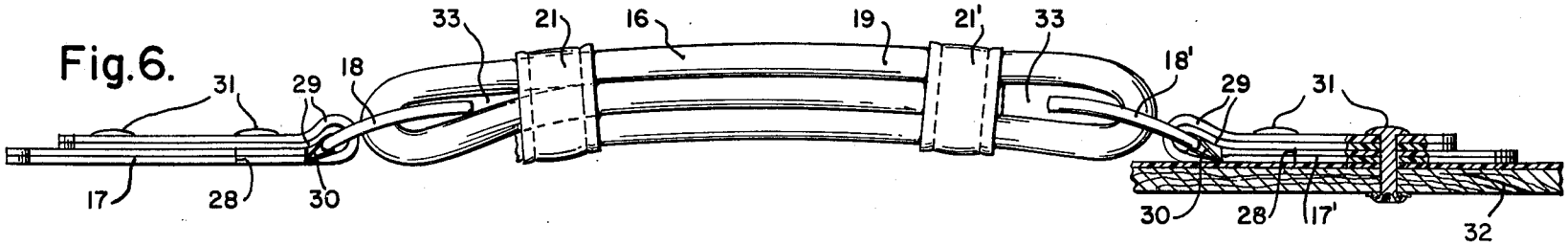
Figure 7:
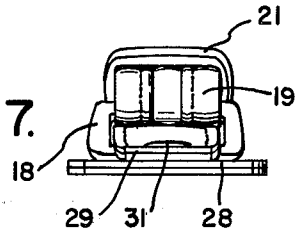

Now if it is desired, at the point of original manufacture or later at anytime, to pack the luggage case in a shipping carton, the hand-grip element 19 may be bent or flattened into a straight line contour, as shown in FIGS. 5, 6 and 7. As will be noted in FIGS. 5 and 6, the spacing of the anchor tabs 17, 17' relative to the overall length of the hand-grip element 16 is such that the metal loops slide inwardly in the elongated slots 33 of the hand-grip element 16, thus enabling the hand-grip element 16 to be flattened into a straight-line contour. By reason of the reenforcing metal strap 24 embodied in the hand-grip element 16, the latter remains in its flat or straight contour until such time as the user desires to use the luggage case. In such case, the user inserts his fingers between the hand-grip element 16 and the body of the luggage case and by pulling upwardly or due to the weight of the load in the case, the hand-grip element 16 is again deformed into its arched or raised contour.

It will be seen that in the flattened or straight contour of the hand-grip element, the luggage case may be packed in a tight-fitting carton without interference by a projecting handle. Thus a smaller carton may be employed than would be required by a luggage case of corresponding volume equipped with a rigid or permanently arched handle.

Figure 10:
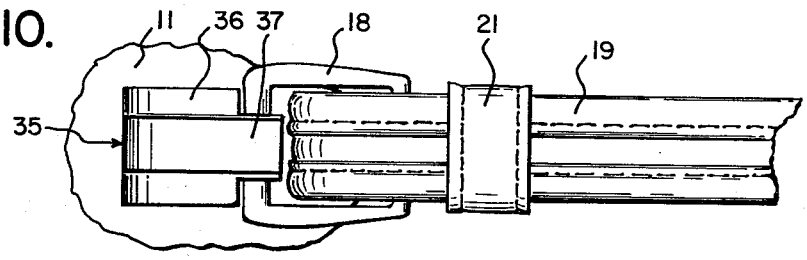
FIGS. 10 and 11 are fragmental plan and side elevational views, respectively, of a modification of the handle assembly shown in FIGS. 2, 3 and 4, in which a different device is employed for attachment of the hand-grip member to the frame of the luggage case.
Figure 11:
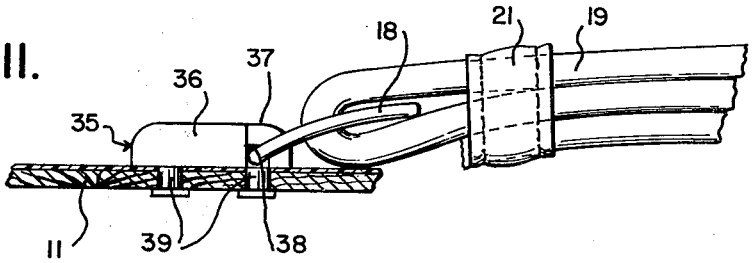

In FIGS. 10 and 11, there is shown fragmentally a variation of the handle assembly previously described in which a different means and method of attachment or swiveling of the loops 18 on the frame or body of the luggage case is provided. In this variation, a pair of similar anchor clips 35, preferably of metal and of decorative design is employed. As seen in the drawings, each anchor clip has a rectangular body portion 36 with a narrow extension 37 at one end. Extending transversely across the extension 37 is a groove or slot 38 for receiving the loop 18. The body portion 36 is attached to the frame 32 or body of the luggage case as by one or more tubular extensions 39, having tapped bores therein for receiving screws. The tubular extensions extend through corresponding holes punched, drilled or otherwise provided in the frame or wall of the body 11 of the luggage case. The extensions 39 are of a length substantially equal to the thickness of the wall or frame of the body 11 of the luggage case. Suitable screws, with heads of a diameter larger than the extensions 39, are thus effective when fully tightened to tightly hold the anchor clips 35 to the outer surface of the body of the luggage case.

The anchor clips 35 are advantageous in that with the loops 18 inserted in the transverse grooves 38 of the extension 37, the attachment of the clips to the body 11 of the luggage case automatically attaches the handle assembly thereto. Similarly, the clips 35 make removal of the handle assembly from the body of the luggage case a relatively simple matter.

Figure 12:
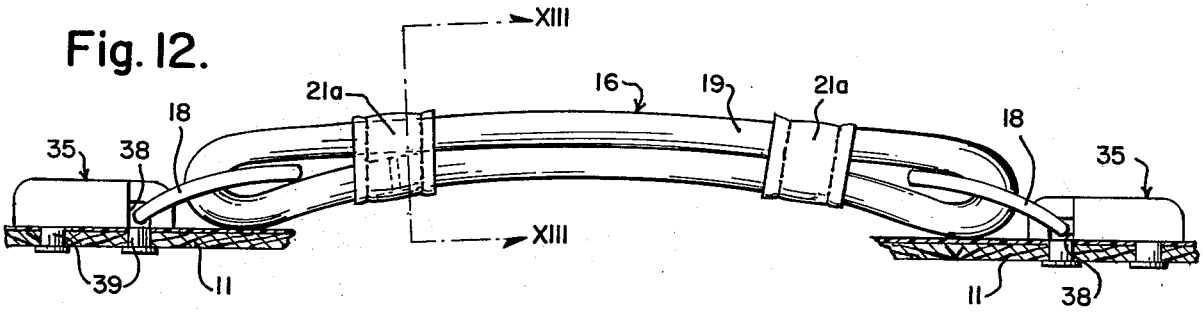
FIG. 12 is a side elevational view of a modified form of hand-grip member having a depth of only two layers of strap.
Figure 13:
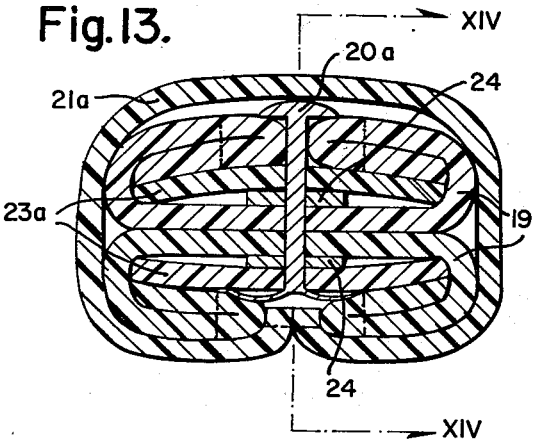
FIG. 13 is a cross-sectional view, taken on the line XIII—XIII of FIG. 12, and shown on somewhat larger scale.
Figure 14:
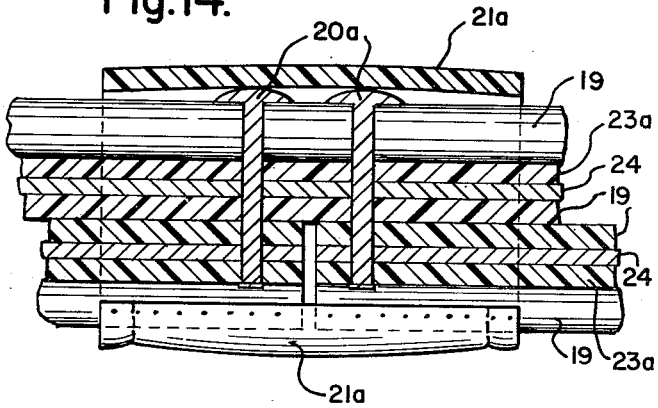
FIG. 14 is a fragmental longitudinal sectional view, taken on line XIV—XIV of FIG. 13.

Referring now to FIGS. 12, 13 and 14, another variation of the handle assembly previously described is shown. In this variation, the strap 19 has a lesser number of folds to form the hand-grip portion 16, only two thicknesses or plies of the strap 19 being employed instead of three plies as in previous embodiments. This variation is adapted for use on light-weight luggage, as the hand-grip portion 16 is of lesser depth than in prior embodiments. The hand-grip portion is quite similar in cross section to the prior embodiment as will be evident from a comparison of FIGS. 13 and 14 with FIGS. 8 and 9 respectively. The two folds or plies of the strap 19 are back-to-back and held together by a shorter rivet 20*a*. In both instances the semi-rigid strap 24 is held centrally of the width of the strap 19, as by the one or more rivets 20*a* passing through holes in the strap 24. In this variation, the opposite ends of the strap 19 are in close juxtaposition and are secured by respective rivets 20*a* (See FIG. 14). A retainer strip 23*a*, corresponding to strip 23 of the previous embodiments, is also provided for holding the strap 24 in place. Bands or sleeves 21*a*, corresponding to bands 21 are further provided in surrounding relation to the rivets, for improved appearance.

Figure 15:
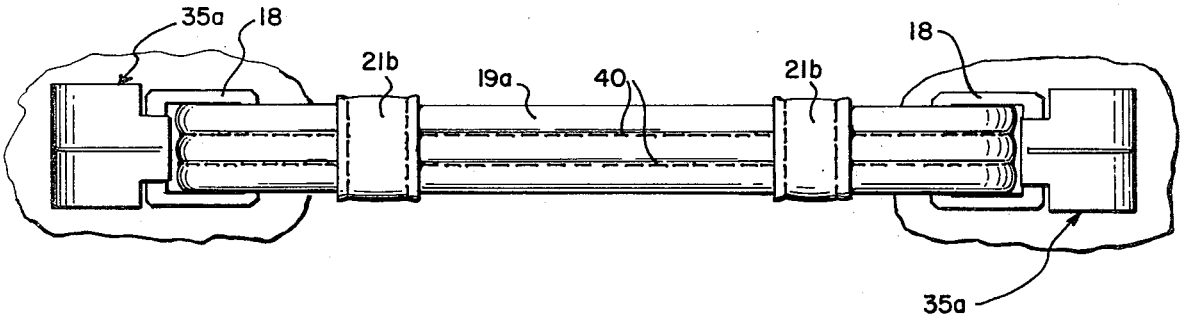
FIG. 15 is a top plan view of a modified form of handle assembly, intended especially for light-weight luggage cases.
Figure 16:
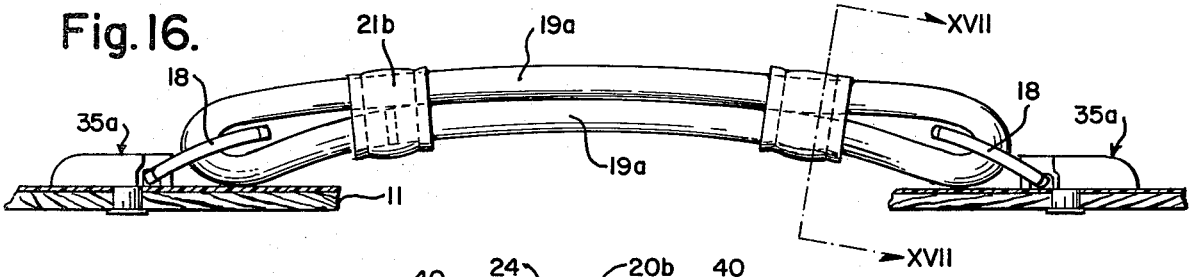
FIG. 16 is a side elevational view of the handle assembly shown in FIG. 15.
Figure 17:
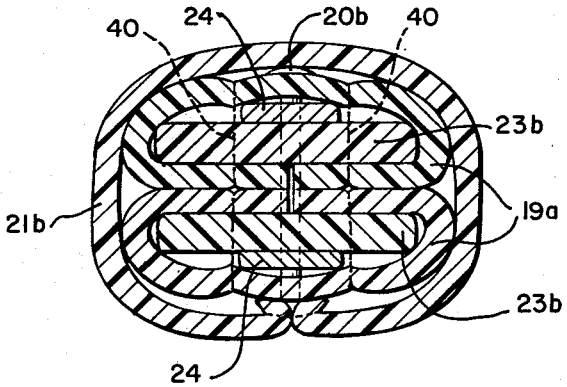
FIG. 17 is a cross-sectional view taken on the line XVII—XVII of FIG. 16.

Referring now to FIGS. 15, 16 and 17, a further variation of the handle assembly is shown, which differs from prior embodiments essentially in providing a strap 19*a* which is arranged differently than strap 19. As will be seen by reference to FIG. 17, strap 19*a* has the sides thereof folded around a filler piece 23*b*, of composition material, and a metal strap 24 is coextensively interposed between the filler piece 23*b* and the outer face of strap 19*a*. As evident in FIG. 16, the opposite ends of a single length of strap 19*a* are brought into close juxtaposition to form a two-ply depth of the hand grip portion 16, the plies being secured together by rivets 20*b*. In addition, the two plies of strap 19*a* are secured together by two parallel extending rows of stitches 40 (FIG. 17) on opposite sides of the strap 24. Sleeves 21*b* are further provided in surrounding relation to the two-ply hand-grip portion to hide the rivet heads and for decorative purposes. Anchor clips 35*a*, similar to anchor clips 35 are provided for attaching the coupling loops 18 to the body 11 or frame of the luggage case.

Figure 18:
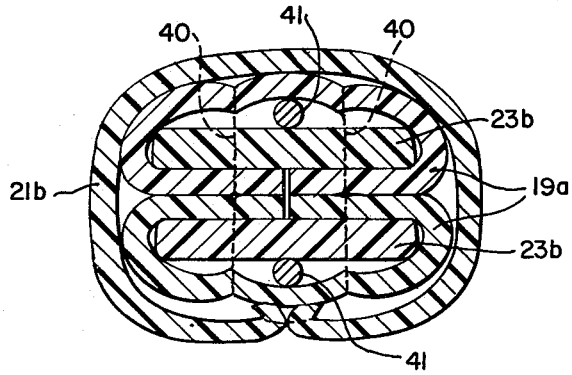
FIG. 18 is a cross-sectional view of a modified form of the handle assembly of FIGS. 15 and 16, showing a reenforcing wire in lieu of a strap.

A variation of the handle assembly of FIGS. 15, 16 and 17 is shown in FIG. 18. In this modification, a wire 41 is substituted for the strap 24, for providing a similar function. The wire 41 is preferably of semi-rigid metal, such as malleable aluminum, which is deformable and which retains different contours to which it is bent. In other respects the handle assembly of FIG. 18 is identical to that of FIGS. 15, 16 and 17 and corresponding elements are identified by the same reference numerals, without further description.

While specific embodiments of handle assemblies are disclosed, and described herein, it will be understood that further variations therefrom are possible within the terms of the following claims.

I claim:

1. In a handle assembly for a luggage case of the type in which a hand-grip element is attached to the body of the luggage case, the improvement wherein said hand-grip element comprises a selected length of flexible strap folded to provide a central portion of multiple plies of strap and loops of a single ply of strap at opposite ends of the central portion, said strap having therein a longitudinally coextensive semi-rigid member which enables said strap to be deformed into various contours and which causes said strap to retain a desired contour until forcibly changed to another contour.

2. A handle assembly according to claim 1, wherein said semi-rigid member is a strap made of malleable metal.

3. A handle assembly according to claim 1, wherein said semi-rigid member is a circular wire made of malleable metal.

4. A handle assembly according to claim 1, wherein bands of strap material are disposed snugly in surrounding relation to the multiple ply portion of said strap at several points.

5. A handle assembly according to claim 1, wherein the multiple ply portion of said strap is provided with spaced holes, and wherein rivets are installed in said holes to retain said plies securely together.

6. A handle assembly according to claim 1, further comprising anchoring means attached to the wall of the luggage case and coupling means between said anchoring means and the single ply loops at opposite ends of the handle assembly for enabling said hand-grip element to be distorted into arched or flat contour.

7. A handle assembly according to claim 1, further including anchor tabs with loops adapted to be secured to the wall of the luggage case in spaced relation, and metallic coupling rings extending through the loops on the hand-grip element and the loops of the anchor tabs, said metallic rings being slidable with respect to the loops on said hand-grip element to enable said hand-grip element to be optionally flattened into a straight-line contour between said anchor tabs, or deformed into an arched contour therebetween.

8. A handle assembly according to claim 1, further including anchoring devices adapted to be secured to the wall of the luggage case, said devices having a flat body portion and a central extension on one side, said extension having a transverse groove therein adjacent the outer surface of the luggage case, and a coupling ring extending through the loops on the hand-grip element and the grooves in said central extension of the anchoring devices.

9. The method of making a handle assembly for a luggage case and the like, which comprises the following steps:

(a) providing a selected length of strap, which strap comprises a coextensive relatively narrow ribbon of bendable metal completely housed along its length by a covering material;

(b) folding the ends of said strap back longitudinally into a multiple of plies connected at each end by a loop of single ply strap;

(c) securing said multiple plies of strap together;

(d) providing means including a coupling ring that extends through the single ply loop at each end thereof for attachment to the luggage case and the like.

* * * * *